US005735518A

United States Patent [19]

Takemoto et al.

[11] Patent Number: 5,735,518

[45] Date of Patent: Apr. 7, 1998

[54] PAPER SLIP TRANSPORT SYSTEM

[75] Inventors: Takatoshi Takemoto, Tokyo; Yoshio Ito; Motohiro Sugawara, both of Hanamaki, all of Japan

[73] Assignee: Kabushiki Kaisha Ace Denken, Tokyo, Japan

[21] Appl. No.: 656,171

[22] PCT Filed: Dec. 9, 1994

[86] PCT No.: PCT/JP94/02071

§ 371 Date: Jun. 7, 1996

§ 102(e) Date: Jun. 7, 1996

[87] PCT Pub. No.: WO95/15900

PCT Pub. Date: Jun. 15, 1995

[30] Foreign Application Priority Data

Dec. 9, 1993 [JP] Japan ..... 5-309149

[51] Int. Cl.[6] ..... B65H 5/02

[52] U.S. Cl. ..... 271/274; 271/275; 271/198

[58] Field of Search ..... 271/198, 272–274, 271/275, 277

[56] References Cited

U.S. PATENT DOCUMENTS 3,516,656 6/1970 Sherman ..... 271/272 X
4,431,179 2/1984 Westover et al. ..... 271/274
4,583,726 4/1986 Nogi et al. ..... 271/274 X
5,492,317 2/1996 Takemoto et al. ..... 271/272 X
5,501,446 3/1996 Takemoto et al. ..... 271/198 X

FOREIGN PATENT DOCUMENTS 61-151947 9/1986 Japan .
3-15851 2/1991 Japan .
3-083747 4/1991 Japan .
2235676 3/1991 United Kingdom .

*Primary Examiner*—Boris Milef
*Attorney, Agent, or Firm*—Seed and Berry LLP

[57] ABSTRACT

Guide passages I for guiding bills S to a main transport passage M are formed. An endless belt 25 coming in contact with one face of each bill S is placed in the main transport passage M. Feed rollers 70 coming in contact with one face of each bill entering the guide passages, swing arms 74 swingably attached to a rotating shaft 73 of the feed roller, pressure rollers 27 rotatably attached to the swing arms so as to come in contact with the feed rollers 70, and coil springs 75 for urging the swing arms 74 in a direction approaching the endless belt 25 are provided upstream of the main transport passage when the guide passage I is considered to be the center of the main transport passage M. The feed roller 70 comes in contact with the pressure roller 27 rotated by motion of the endless belt 25 and is rotated by rotation of the pressure roller for transporting bills in the guide passage.

2 Claims, 11 Drawing Sheets

PAPER SLIP TRANSPORT SYSTEM

TECHNICAL FIELD

This invention relates to a paper slip transport system for guiding paper slips from paper slip dischargers, scattered along a main transport passage to the main transport passage, and for transporting the paper slips along the main transport passage.

TECHNICAL BACKGROUND

A pachinko (Japanese pinball) hall has a plurality of pachinko islands, each of which comprises a plurality of pachinko machine for playing games with pachinko balls, a plurality of ball lending machines for accepting a bill and dispensing as many pachinko balls as the number of balls corresponding to the denomination of the bill, a cashbox for storing the bills input to the ball lending machines, and a bill transport system for transporting the bills input to the ball lending machines to the cashbox. The pachinko island has the pachinko machines and the ball lending machines arranged alternately in a row for defining a pachinko machine row. The bill transport system is disposed along the pachinko machine row behind the row.

As shown in FIG. 14, the bill transport system has a guide passage I for guiding paper slips from the ball lending machine to a main transport passage M in addition to the main transport passage M disposed in line along the pachinko machine row. The main transport passage M is provided with an endless belt 25 along the transport passage M and pressure rollers 27 and 28 so as to face the endless belt 25. In the main transport passage M, bills are sandwiched between the endless belt 25 and the pressure rollers 27 and 28 and the sandwiched bills are transported by driving the endless belt 25. On the other hand, a feed roller 91 is placed on the guide passage I so that a part of the feed roller projects into the inside of the guide passage I. The feed roller 91 is linked with the pressure roller 27 and a belt 92 placed downstream from the main transport passage M when the guide passage I is considered to be the center of the main transport passage M. In the guide passage I, bills guided thereinto are sent to the main transport passage M by the feed roller 91 rotated by rotation of the pressure roller 27.

However, in such a related art, the driving force of the endless belt 25 is transmitted to the feed roller 91 via the two pressure rollers 27 and the belt 92, which are power transmission members, and in addition, power is transmitted by a friction force between the endless belt 25 and the pressure rollers 27, between the pressure rollers 27 and the belt 92, and between the belt 92 and the feed roller 91. Thus, the driving force of the endless belt 25 cannot be efficiently transmitted to the feed roller 91 and sometimes bills may be unable to be transported through the guide passage I.

DISCLOSURE OF INVENTION

It is therefore an object of the invention to provide a paper slip transport system that can efficiently transmit the driving force of an endless belt to feed rollers for securely transporting paper slips through guide passages.

To this end, according to the invention, there is provided a paper slip transport system for guiding paper slips from paper slip dischargers, scattered along a main transport passage to the main transport passage, and transporting the paper slips along the main transport passage, the transport system comprising:

a long endless belt being placed along the main transport passage and having an outer peripheral surface coming in contact with one of front and rear faces of the paper slips transported along the main transport passage;

a belt drive mechanism for turning the endless belt;

a plurality of pressure rollers being scattered along the main transport passage and having outer peripheral surfaces coming in contact with the other of front and rear faces of the paper slips transported along the main transport passage for pressing the paper slips against the endless belt;

guide passage members each formed with an internal guide passage for guiding paper slips from the paper slip discharger to the main transport passage;

feed rollers each having a rotating shaft perpendicular to a transport direction of the paper slips and parallel to the paper slips being transported and having at least a part entering the inside of the guide passage member so that the outer peripheral surface of the feed roller comes in contact with one of front and rear faces of the bills arriving at the guide passage from the paper slip discharger;

swing arms each having the other end attached to the rotation shaft so that one end of the swing arm can swing in a direction approaching the endless belt with the rotating shaft of the feed roller as the center; and urging members each for urging the one end of the swing arm in the direction approaching the endless belt, wherein the pressure roller placed near the guide passage among the pressure rollers is attached rotatably to the swing arms so that the outer peripheral surface of the pressure roller comes in contact with the outer peripheral surface of the feed roller.

In the paper slip transport system, when no paper slips are transported, each pressure roller attached to the swing arms comes in contact with the endless belt because one end of each of the swing arms is urged in the direction approaching the endless belt by the urging member. Therefore, if the endless belt moves, the pressure roller rotates. When the pressure roller rotates, the feed roller coming in contact with the pressure roller also rotates.

When a paper slip is fed into the guide passage from the paper slip discharger after the endless belt is moved, it comes in contact with the rotating feed roller and is sent to the main transport passage where the bill is transported in a state in which it is sandwiched between the endless belt and the pressure roller.

Thus, the feed roller is rotated directly by the pressure roller rotated by the motion of the endless belt, whereby bills in the guide passage are transported. Therefore, the driving force of the endless belt can be transmitted efficiently to the feed roller. Since no belt placement space is required between the feed roller and the pressure roller, the mechanism for transporting bills in the guide passage can be miniaturized.

In the paper slip transport system, preferably the guide passage formed inside the guide passage member is shaped so as to bend in a downstream direction of the main transport passage gradually as it approaches the main transport passage in order to smoothly guide paper slips from the paper slip discharger to the main transport passage, and the feed rollers, the swing arms, the pressure rollers, and the urging members are placed upstream of the main transport passage with the guide passage as the center.

When the guide passage is shaped so as to bend in the downstream direction of the main transport passage gradually as it approaches the main transport passage in order to smoothly guide paper slips from the paper slip discharger to the main transport passage, the angle which the guide passage forms with the main transport passage becomes acute upstream of the main transport passage with the guide passage as the center and only a narrow space is formed therebetween; this place is prone to become a dead space. Since the mechanism, including the feed roller, etc., for transporting paper slips in the guide passage is disposed upstream of the main transport passage when the guide passage is considered to be the center of the main transport passage, the effective use of places prone to become dead spaces can be made.

BEST MODE FOR CARRYING OUT THE INVENTION

Figure 4:
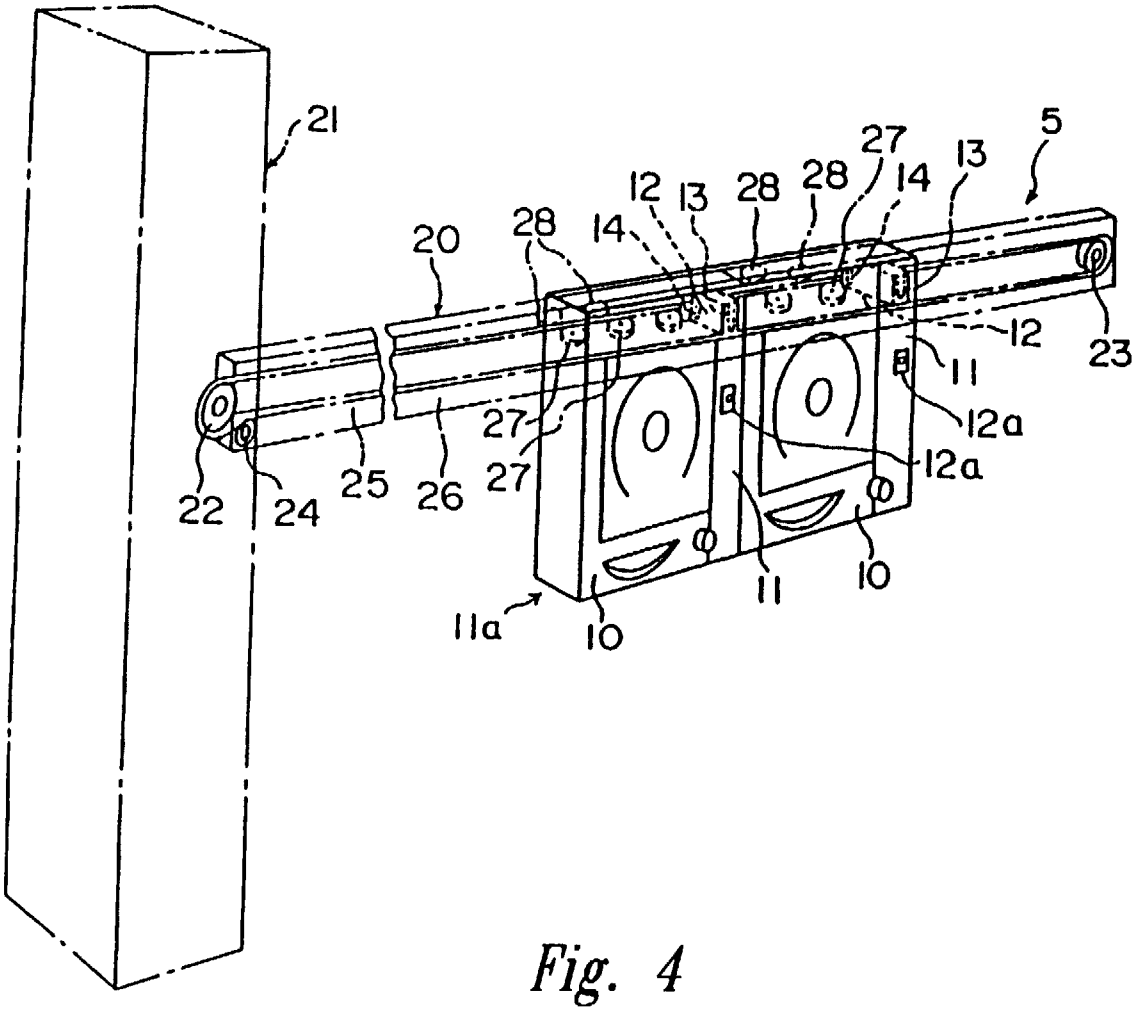
FIG. 4 is a perspective view of a pachinko machine island according to the invention.
Figure 5:
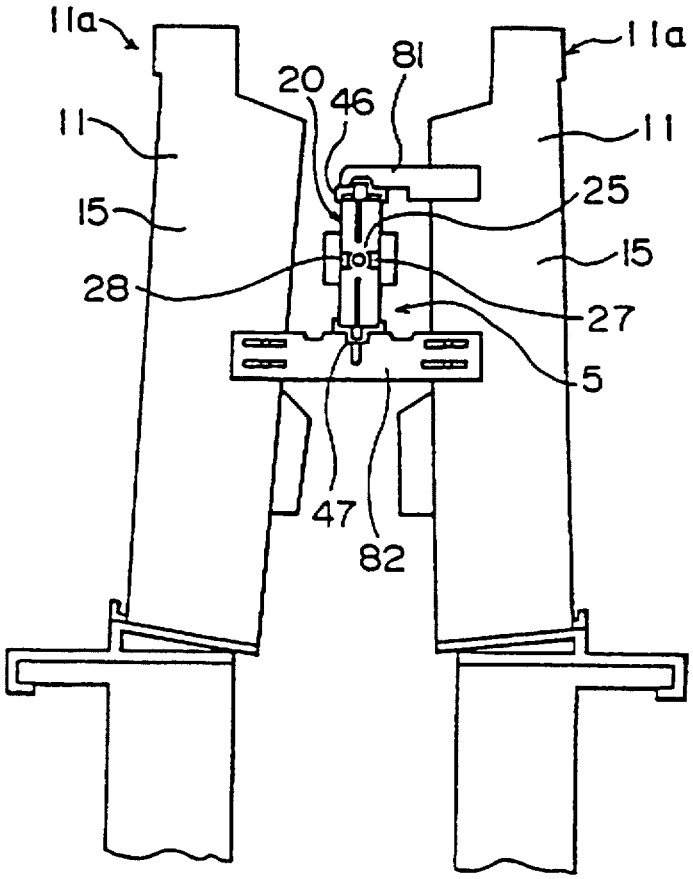
FIG. 5 is a side view of the pachinko machine island according to the invention.

As shown in FIG. 4, a pachinko machine island comprises a plurality of pachinko machine 10, 10, . . . for playing games with pachinko balls, a plurality of ball lending machines 11, 11, . . . for accepting a bill and dispensing as many pachinko balls as the number of balls corresponding to the denomination of the bill, a cashbox 21 for storing the bills input to the ball lending machines 11, 11, . . . , and a bill transport system 5 for transporting the bills input to the ball lending machines 11, 11, . . . to the cashbox 21. The pachinko machines 10, 10, . . . and the ball lending machines 11, 11, . . . are arranged alternately in a row for defining a pachinko machine row 11*a*. The pachinko machine island has two pachinko machine rows 11*a* and 11*a* spaced from each other at a given interval and placed back to back in parallel, as shown in FIG. 5. The bill transport system 5 is disposed along the pachinko machine row 11*a* between the two pachinko machine rows 11*a* and 11*a*. The cashbox 21 is placed at one end of the two pachinko machine rows 11*a* and 11*a*.

As shown in FIG. 4, the ball lending machine 11 has a bill validation section 12 for determining the validity and denomination of a bill and a ball dispensing section 12*a* for dispensing as many pachinko balls as the number of balls corresponding to the denomination of the bill determined by the bill validation section 12. The bill validation section 12 is formed with a bill slot 13 at a position on the front of the ball lending machine 11 and a bill outlet 14 at a position on the rear of the ball lending machine 11.

The bill transport system 5 defines a linear charge collection line 20 along the rear of each pachinko machine row 11*a*. A drive pulley 22 and a driven pulley 23 are placed on both ends of the charge collection line 20. An endless belt 25 having a circular cross section is placed on the pulleys 22 and 23. Pairs of pressure rollers 27 and 28 between which the endless belt 25 is sandwiched are disposed between the drive pulley 22 and the driven pulley 23. A tension pulley 24 for adjusting the tension of the endless belt 25 is disposed near the drive pulley 22.

Figure 6:
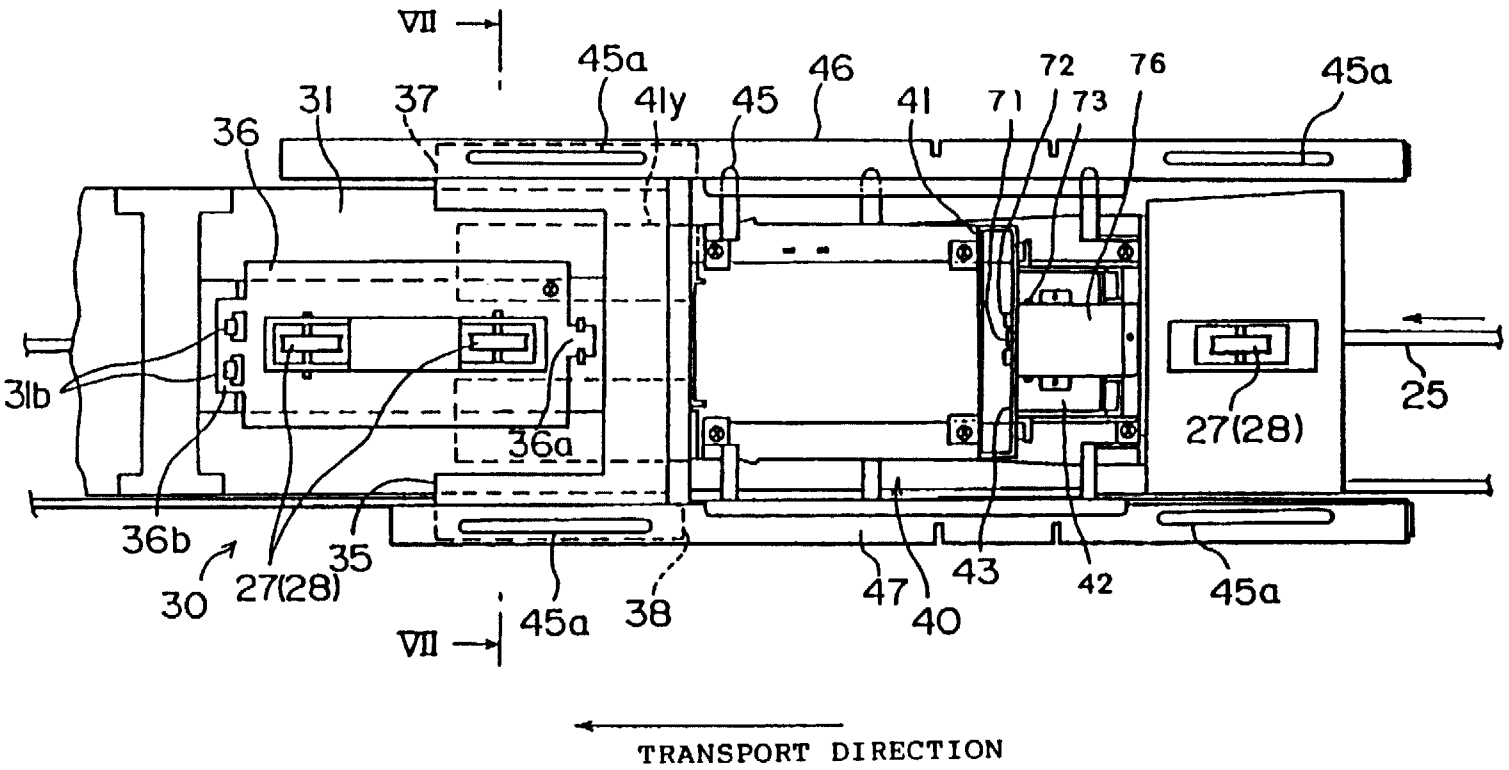
FIG. 6 is a front view of a transport unit and a guide unit according to the invention.

In addition to the components such as the pulleys 22 and 23 and the endless belt 25, the bill transport system 5 comprises transport units 30, 30, . . . for defining a main transport passage M to transport bills along the endless belt 25 and transporting the bills to the cashbox 21 along the main transport passage M and a plurality of guide units 40, 40, . . . for guiding bills from the ball lending machines 11, 11, . . . to the main transport passage M, as shown in FIG. 6.

The transport units 30 and the guide units 40 forming a part of the charge collection line 20 are supported from top and bottom by coupling guide members 46 and 47, pachinko island main body frames, as shown in FIG. 5. The top and bottom coupling guide members 46 and 47 are supported on side wall plates 15 of the ball lending machines 11 via mounting hardware pieces 81 and 82.

Figure 11:
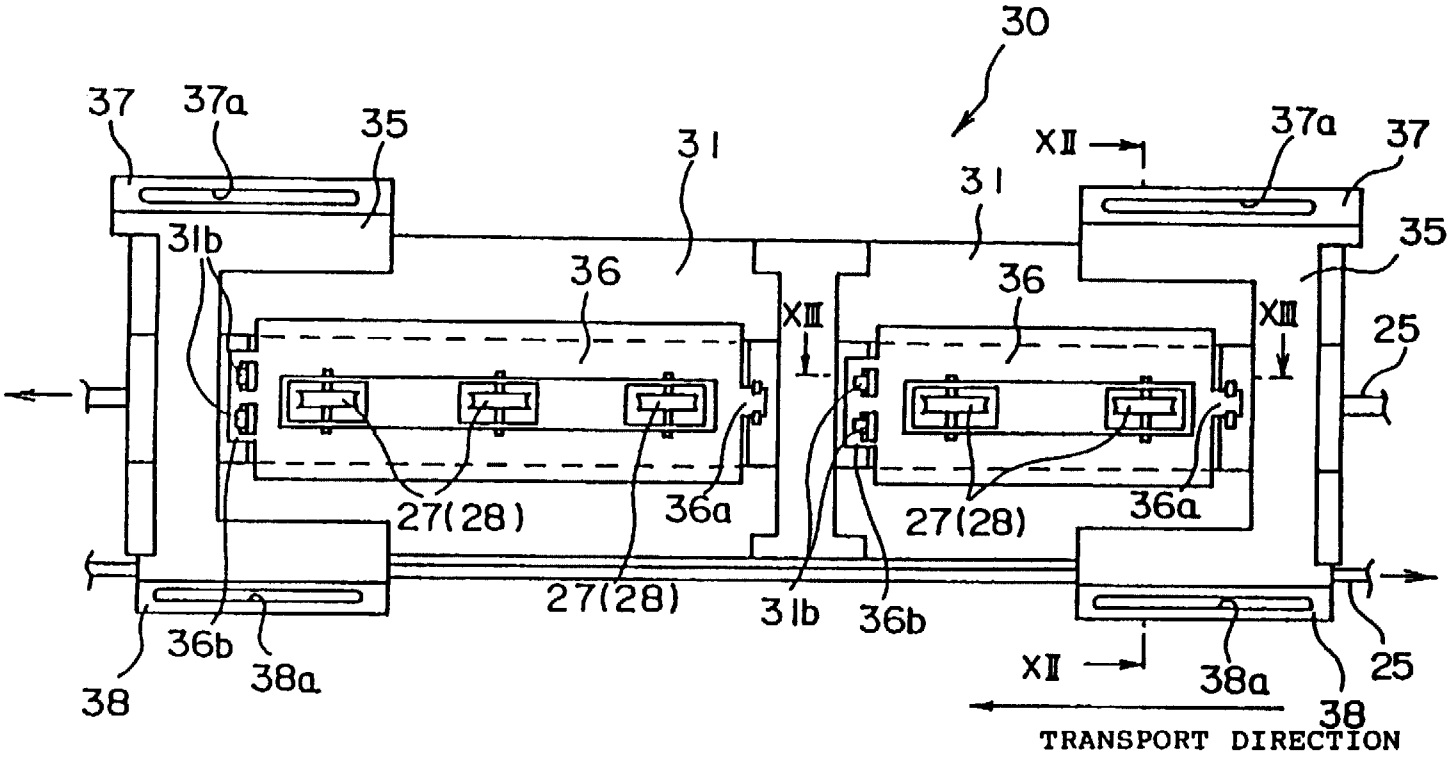
FIG. 11 is a front view of the transport unit according to the invention.
Figure 12:
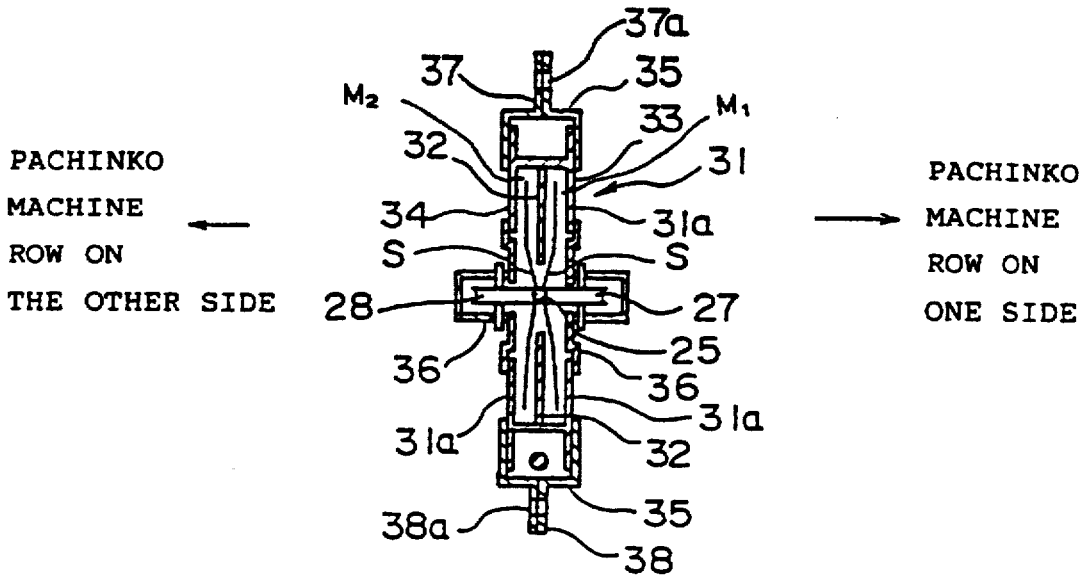
FIG. 12 is a sectional view taken on line XII—XII in FIG. 11.

As shown in FIGS. 11 and 12, the transport unit 30 comprises a transport passage member 31 for surrounding transported bills from top and bottom and left and right and defining the main transport passage M, joint members 35 and 35 disposed on both ends of the transport passage member 31 in the bill transport direction, and the above-mentioned pressure rollers 27 and 28.

Figure 13:
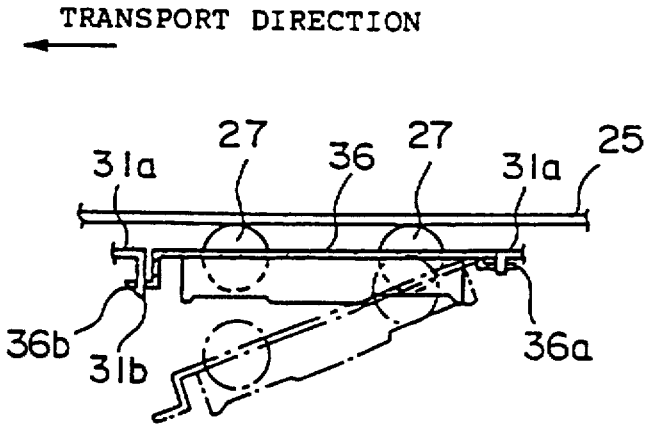
FIG. 13 is a sectional view taken on line XIII—XIII in FIG. 11.
Figure 14:
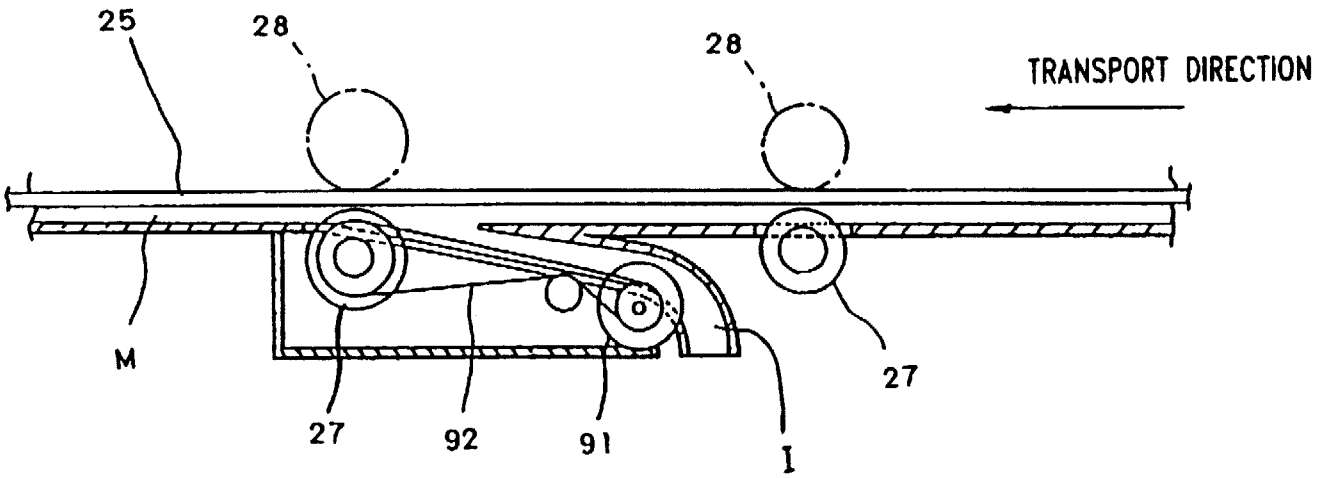
FIG. 14 is a sectional view in the proximity of a guide passage of a conventional paper slip transport system.

As shown in FIG. 12, the transport passage member 31 has a first transport passage definition section 33 for defining main transport passage M1 for the pachinko machine row on one side and a second transport passage definition section 34 for defining main transport passage M2 for the pachinko machine row on the other side with the endless belt 25 as the center and a separation section 32 for separating the first transport passage definition section 33 and the second transport passage definition section 34. The above-mentioned pressure rollers 27 and 28 are placed on one pachinko machine row side and the other side with the endless belt 25 as the center so as to come in contact with the endless belt 25. Each of the pressure rollers 27 and 28 has a rotating shaft perpendicular to the direction in which the main transport passage M extends-and parallel to transported bills S. The pressure roller 27, 28 has an outer peripheral surface formed with a recess where an intermediate part in the direction parallel to the rotating shaft is dented toward the rotating shaft. The recess is gently bent corresponding to the circular sectional shape of the endless belt 25 in almost the same curvature. The pressure roller 27, 28 is covered with a pulley mounting plate 36, 36 and has the rotating shaft fitted thereto. Each of the transport passage definition sections 33, 34 of the transport passage member 31 has side walls 31*a*, 31*a* formed with openings. The pulley mounting plate 36 is fitted to the side wall 31*a* so as to block the openings of the side wall 31*a*. As shown in FIG. 13, one end 36*a* of the pulley mounting plate 36 in the bill transport direction is fitted to a plate mounting part formed on one opening margin of the side wall 31*a* so that it can swing with the plate mounting part as the center. The other end of the pulley mounting plate 36 in the transport direction is formed with an engagement part 36*b* that can be engaged with and disengaged from a hook part 31*b* formed on the other opening margin of the side wall 31*a*.

A joint member 35 has coupling rail parts 37 and 38 extending in the bill transport direction on the top and bottom of an end of the transport passage member 31 in the transport direction. The coupling rail parts 37 and 38 are formed with long holes 37*a* and 38*a* cut through from one pachinko machine row side to the other side and elongated in the bill transport direction.

Figure 7:
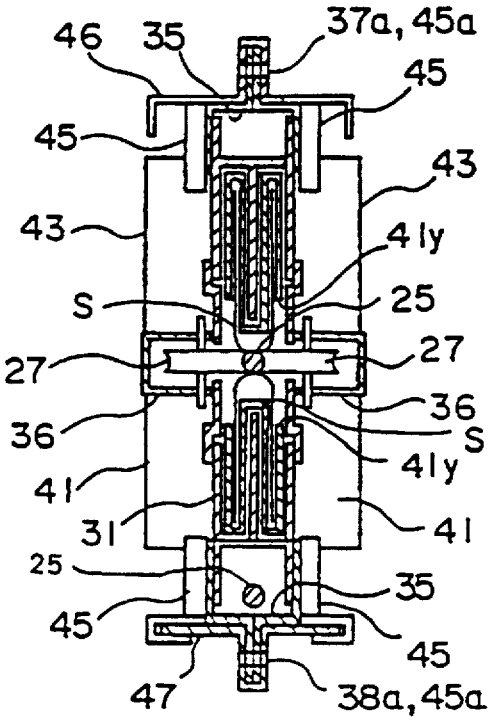
FIG. 7 is a sectional view taken on line II—II in FIG. 6.
Figure 8:
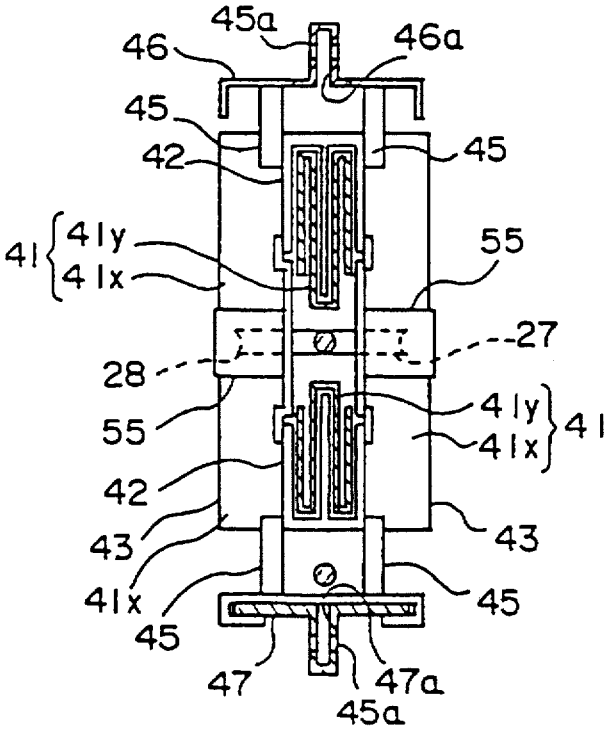
FIG. 8 is a sectional view taken on line VIII—VIII in FIG. 10.
Figure 9:
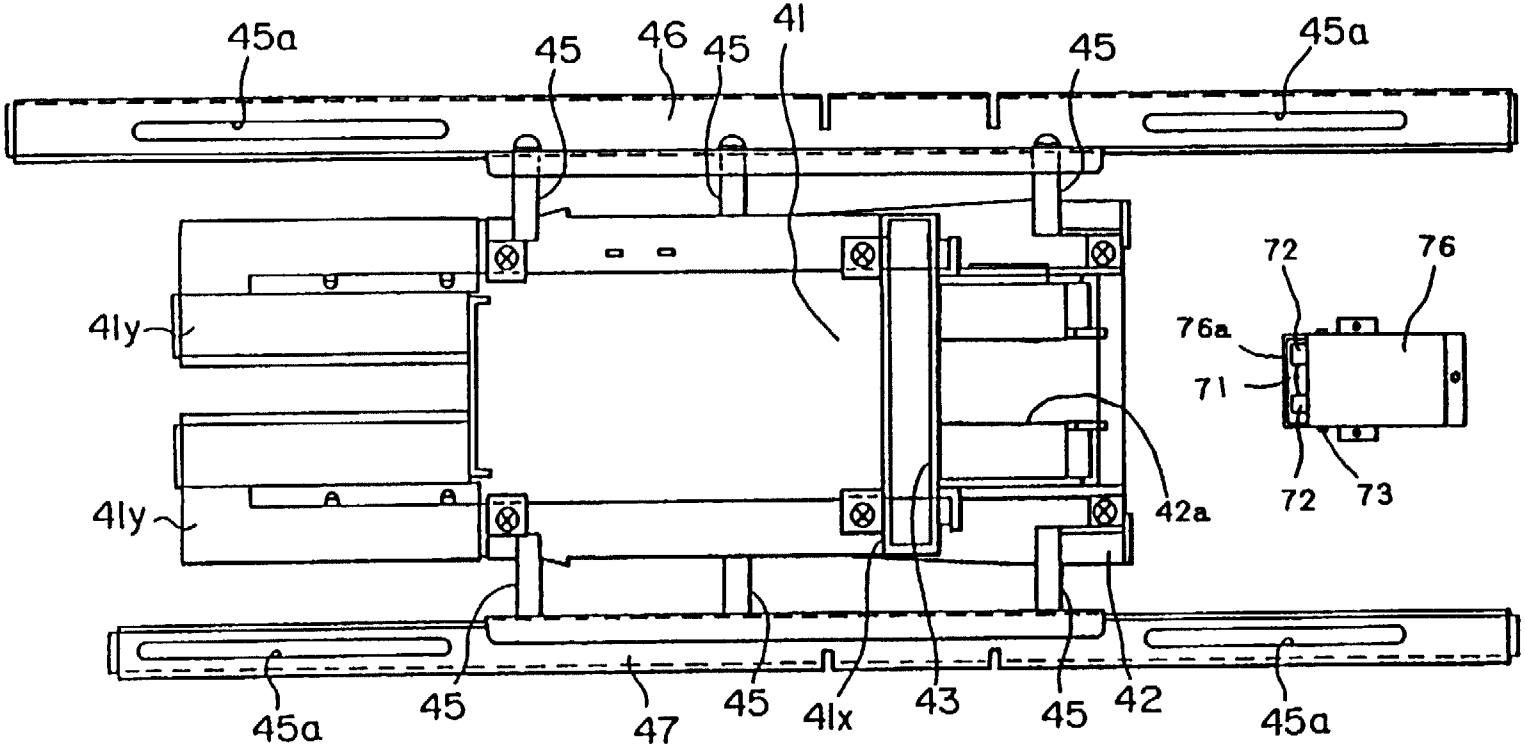
FIG. 9 is a front view of the guide unit according to the invention.
Figure 10:
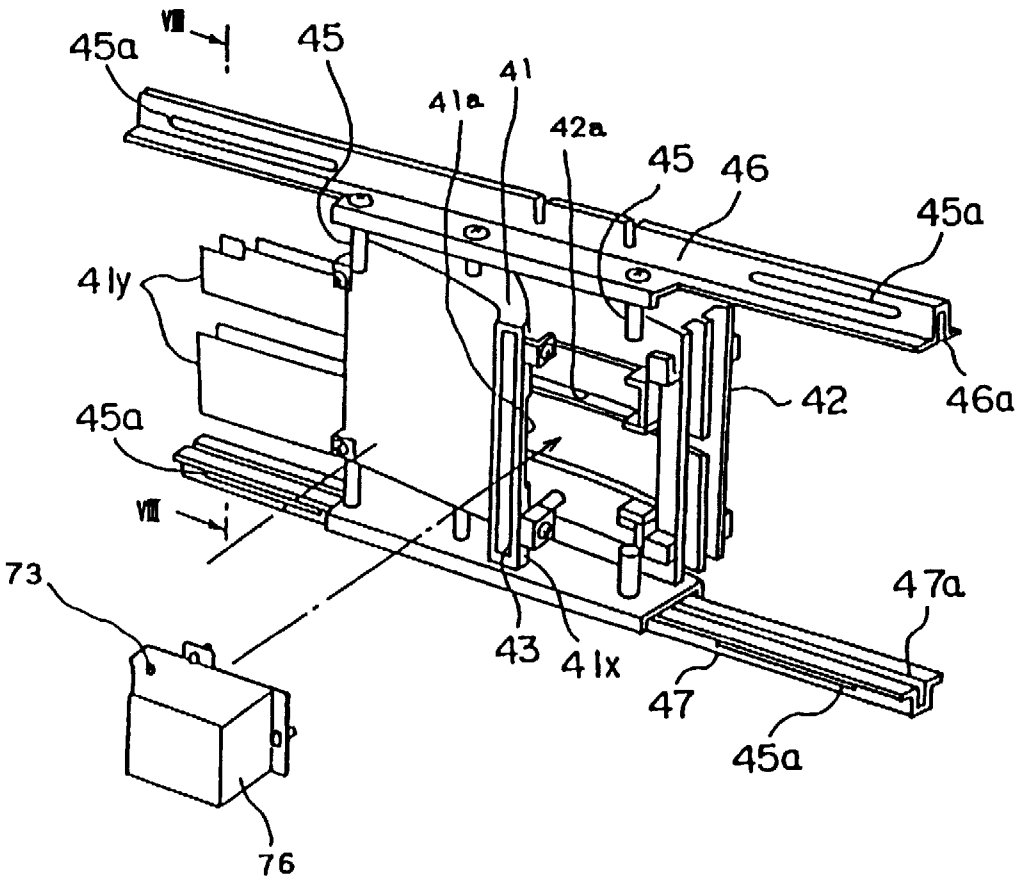
FIG. 10 is a perspective view of the guide unit according to the invention.

As shown in FIGS. 9 and 10, the guide unit 40 has a transport passage member 42 for forming a part of the main transport passage M and a guide passage member 41 formed with a guide passage I for guiding bills from the bill outlet 14 of the ball lending machine 11 to the main transport passage M. The transport passage member 42 has a similar cross sectional shape to that of the transport passage member 31 of the transport unit 30 as shown in FIGS. 12, 10, and 8. When the guide unit 40 and the transport unit 30 are coupled, their transport passage members 42 and 31 are abutted. FIG. 8 does not show the cross section of the transport passage member 42. The guide passage member 41 has a guide section 41*x* which is formed with a bill inlet 43 communicating with the bill outlet 14 of the ball lending machine 11 and which gradually bends in the downstream direction of the main transport passage M as it approaches the main transport passage M and a confluence section 41*y* which communicates with the guide section 41*x* and is placed inside the transport passage member 42 forming a part of the main transport passage M. As shown in FIGS. 8 and 10, the confluence section 41*y* has a part projecting in the transport destination direction from the transport passage member 42. When the guide unit 40 and the transport unit 30 are coupled, the projections of the confluence section 41*y* are fitted into the transport passage member 31 of the transport unit 30 to secure bill transfer from the guide unit 40 to the transport unit 30, as shown in FIGS. 6 and 7.

Both the transport passage member 42 and the guide passage member 41 of the guide unit 40 are coupled to the top coupling guide member 46 and the bottom coupling guide member 47 by screws 45, 45, . . . . as shown in FIGS. 6 and 10. The coupling guide members 46 and 47 are formed with grooves 46*a* and 47*a* elongated in the bill transport direction, into which the coupling rail parts 37 and 38 of the transport unit 30 can be fitted. Like the coupling rail parts 37 and 38 of the transport unit 30, the coupling guide members 46 and 47 are formed with elongated holes 45*a* and 45*a* cut through from one pachinko machine row side to the other side and elongated in the bill transport direction.

As described above, the guide unit 40 is coupled with the transport unit 30 in a state in which the confluence section 41*y* of the guide member 41 of the guide unit 40 is fitted into the transport passage member 31 of the transport unit 30 and the transport passage member 42 of the guide unit 40 and the transport passage member 31 of the transport unit 30 are abutted. The coupling rail parts 37 and 38 of the transport unit 30 are fitted into the grooves 46*a* and 47*a* of the coupling guide members 46 and 47 connected to the guide unit 40 by the screws 45. Screws are inserted into the elongated holes 45*a* and 45*a* of the coupling guide members 46 and 47 and the elongated holes 37*a* and 38*a* of the coupling rail parts 37 and 38 of the transport unit 30 for coupling the coupling guide members 46 and 47 and the transport unit 30 by the screws. By the way, since the elongated holes 45*a*, 37*a*, . . . into which the screws are inserted, are elongated in the bill transport direction, the relative positional relationship between the transport unit 30 and the coupling guide members 46 and 47 in the bill transport direction can be adjusted. Therefore, the relative positional relationship, in the bill transport direction, of the guide unit 40 fixed to the coupling guides 46 and 47 by the screws 45, with the transfer unit 30, can also be adjusted.

Figure 1:
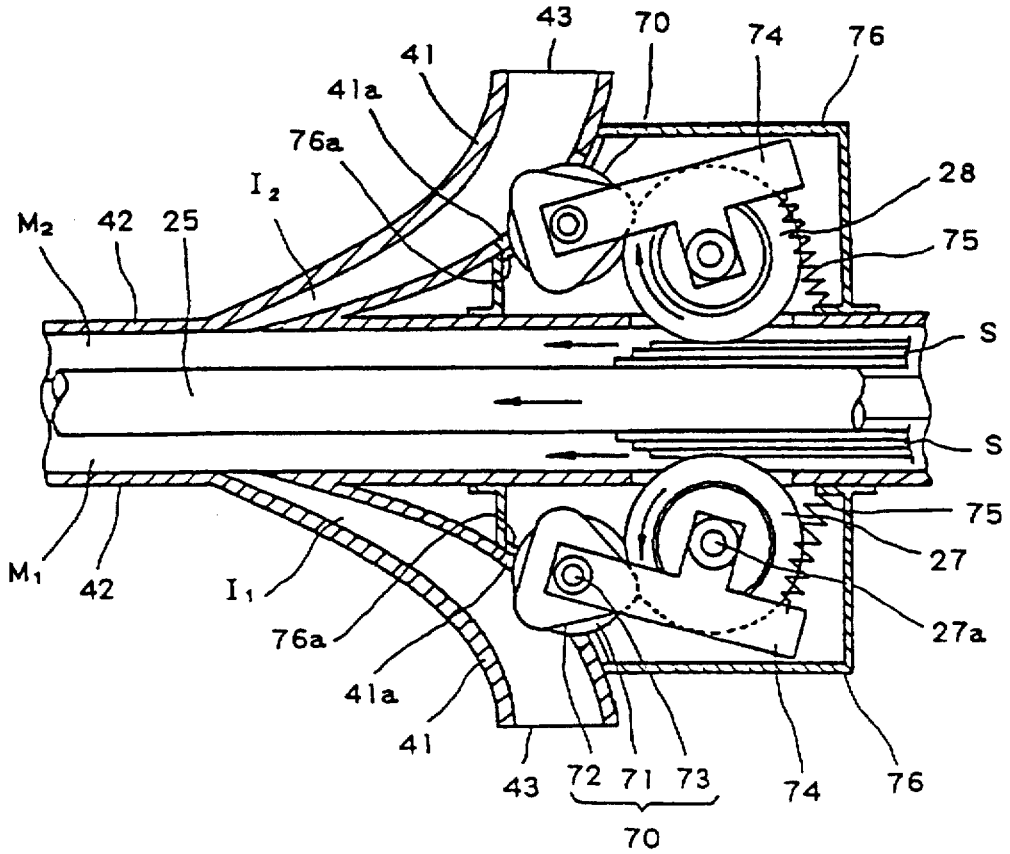
FIG. 1 is a sectional view of a transport system in the proximity of a guide passage in one embodiment according to the invention.
Figure 2:
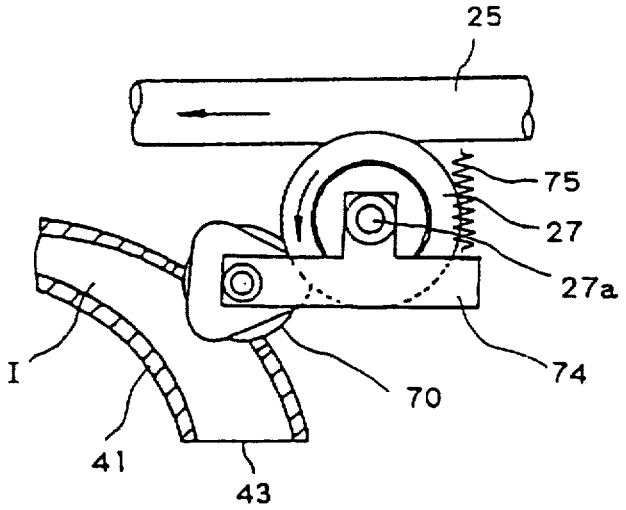
FIG. 2 is a sectional view of the transport system in the proximity of the guide passage in the embodiment according to the invention where members such as a transport passage member are omitted.
Figure 3:
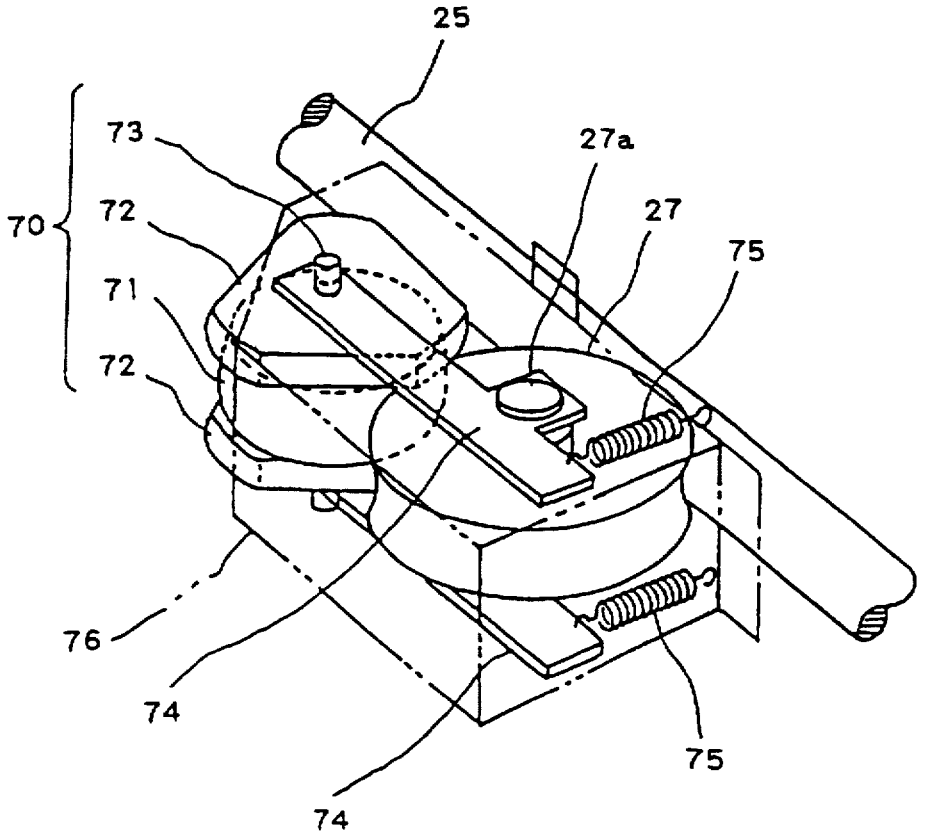
FIG. 3 is a perspective view of a feed roller, a pressure roller, etc., in the embodiment according to the invention.

As shown in FIGS. 1–3, the guide unit 40 further includes pressure rollers 27, 28 placed on both sides of the endless belt 25, feed rollers 70, 70 placed upstream of the main transport passage M with the guide passage I defined by the guide passage member 41 as the center, swing arms 74 and 74 mounted swingably on rotating shafts 73, 73 of the feed rollers 70, 70, coil springs 75 and 75 for urging the swing arms 74 and 74 in a direction approaching the endless belt 25, and a case 76 covering the components. One feed roller 70 has a feed drive roller 71 coming in contact with the outer peripheral surface of the pressure roller 27, feed driven rollers 72, 72 each having a part facing the inside of the guide passage I and coming in contact with bills S passing therethrough, and their rotating shaft 73. The feed drive roller 71 is shaped like a barrel with the longitudinal center of the rotating shaft 73 swelling in a direction going away from the rotating shaft 73 to enlarge the contact area with the pressure roller 27 whose outer peripheral surface is dented. The feed driven roller 72 is shaped like an equilateral triangle having round vertexes. The feed driven rollers 72 and 72 are fixed to both ends of the barrel-shaped feed drive roller 71. The feed drive roller 71 and the feed driven rollers 72 and 72 are fitted to the rotating shaft 73 so that they can rotate unitedly with respect to the rotating shaft 73. The distance from the rotating shaft 73 to the part corresponding to the vertex of the feed driven roller 72 shaped like substantially a regular triangle is larger than that from the rotating shaft 73 to the outer peripheral surface of the barrel-shaped feed drive roller 71. The part corresponding to the vertex of the feed driven roller 72 faces the inside of the guide passage I and comes in contact with bills passing therethrough. The rotating shaft 73 is attached to the case 76 so as to extend in a direction perpendicular to the bill transport direction in the guide passage I and become parallel to the bills.

To make one end swing in a direction approaching the endless belt 25, the swing arm 74 has the other end attached to the rotating shaft 73 of the feed roller 70. A rotating shaft 27*a* of the pressure roller 27 is attached to the swing arm 74 so that the outer peripheral surface of the pressure roller 27 comes in contact with the outer peripheral surface of the feed driver roller 71. The coil spring 75 has one end attached to the other end of the swing arm 74 and the other end attached to the case 76.

The case 76 is formed with a notch 76*a* for allowing the outer peripheral surface of the feed roller 70 to project beyond the case 76. The case 76 to which the feed roller 70, the pressure roller 27, the swing arms 74, and the coil springs 75 are attached is fixed to the guide passage member 41 and the transport passage member 42 so as to come in contact with the members 41 and 42 upstream of the main transport passage M with the guide passage I as the center, as shown in FIGS. 1 and 10.

The guide passage member 41 is formed with a notch 41*a* for allowing the outer peripheral surface of the feed roller 70 to face the inside of the guide passage I and the transport passage member 42 is also formed with a notch 42*a* for allowing the outer peripheral surface of the pressure roller 27 to face the inside of the main transport passage M.

Next, the operation of the transport system 5 of the embodiment will be discussed.

As shown in FIG. 2, each of the pressure rollers 27 and 28 has the outer peripheral surface coming in contact with the outer peripheral surface of the endless belt 25 and rotates whenever the end belt 25 operates. The feed drive roller 71 of the guide unit has the outer peripheral surface coming in contact with the outer peripheral surface of the pressure roller 27 of the guide unit and always rotates so long as the pressure roller 27 rotates. Therefore, the feed driven rollers 72 fixed to both ends of the feed drive roller 71 also always rotate so long as the pressure roller 27 rotates.

When a bill enters the guide passage I of the guide unit 40 from the outlet 14 of the ball lending machine 11, it comes in contact with the feed driven rollers 72. The important point is that the guide passage I is bent as described above. Thus, the bill entering the guide passage I swells to the feed roller side and always comes in contact with the bill, which comes 71. The bill, which comes in contact with the rotating feed driven rollers 71, is transported to the main transport passage M.

When the bill S arrives at the main transport passage M, it is sandwiched between the endless belt 25 and the pressure roller 27 and is transported in the main transport passage M to the cashbox 21. In this process, when the bill S being transported in the main transport passage M arrives near a guide passage I downstream from the guide passage 1 into which the bill S is fed, it is sandwiched between the pressure roller 27 of the guide unit 40 providing the downstream guide passage I and the endless belt 25 and is transported furthermore downstream, as shown in FIG. 1. At this time, the pressure roller 27 comes off the endless belt 25, but is urged in the direction approaching the endless belt 25 by the coil springs 75, so that the bill S is pressed against the endless belt 25 by the pressure roller 27 and can be allowed to come in contact with the endless belt 25.

Thus, in the embodiment, the feed roller 70 is rotated directly by the pressure roller 27 rotated by the motion of the endless belt 25, whereby bills in the guide passage I are transported. Therefore, the driving force of the endless belt 25 can be transmitted efficiently to the feed roller 70. Since no belt placement space is required between the feed roller 70 and the pressure roller 27, the mechanism for transporting bills in the guide passage I can be miniaturized.

The angle which the guide passage I forms with the main transport passage M becomes obtuse downstream from the main transport passage M with the guide passage I as the center and a wide space can be provided; it is desired to use the space as occupation space of other machines than the pachinko machine, transport system 5, etc. Particularly, this tendency is strong in the proximity of the cashbox, and the trouble to extend the main transport passage M may be taken to provide a wide space on both sides of the main transport passage M in the proximity of the cashbox. On the other hand, the angle which the guide passage I forms with the main transport passage M becomes acute upstream of the main transport passage M with the guide passage I as the center and only a narrow space is formed therebetween; the place is prone to become a dead space. Since the embodiment provides the mechanism, including the feed roller 70, etc., for transporting bills in the guide passage I upstream of the main transport passage M with the guide passage I as the center, the effective use of places prone to become dead spaces can be made and the need for taking the trouble to extend the main transport passage M is eliminated.

In the embodiment, the feed driven rollers 72 come in contact with bills in the guide passage I for transporting the bills. However, the feed driven rollers 72 may be omitted and the feed drive roller 71 may have a slightly enlarged diameter so as to come in contact with a bill in the guide passage I for directly transporting the bill.

In the guide passage I, to increase the contact of the feed roller 70 with bills, a paper slip pressure member such as a pressure roller may be provided at a position opposed to the feed roller 70.

We claim:

1. A paper slip transport system for guiding paper slips from paper slip dischargers scattered along a main transport passage to the main transport passage and transporting the paper slips along the main transport passage, said transport system comprising:

an endless belt placed along said main transport passage and having an outer peripheral surface coming in contact with one of front and rear faces of the paper slips transported along said main transport passage;

a belt drive mechanism for turning said endless belt;

a plurality of pressure rollers scattered along said main transport passage and having outer peripheral surfaces coming in contact with the other of front and rear faces of the paper slips transported along said main transport passage for pressing the paper slips against said endless belt;

guide passage members each formed with an internal guide passage for guiding paper slips from a respective one of said paper slip dischargers to said main transport passage;

feed rollers each having a rotating shaft perpendicular to a transport direction of the paper slips in a respective one of said guide passages and parallel to the paper slips being transported and having at least a part entering the inside of a respective one of said guide passage members so that an outer peripheral surface of each of said feed rollers comes in contact with one of front and rear faces of the paper slips arriving at the respective guide passage from the respective paper slip discharger;

swing arms each having one end attached to a respective one of said rotating shafts so that the other end of said each swing arm can swing in a direction approaching said endless belt with the respective rotating shaft of said feed roller as the center; and urging members each for urging said other end of a respective one of said swing arms in the direction approaching said endless belt, wherein each said pressure roller is located adjacent a respective one of the guide passages and is attached rotatably to a respective one of said swing arms so that an outer peripheral surface of said pressure roller comes in contact with the outer peripheral surface of a respective one of said feed rollers.

2. The paper slip transport system as claimed in claim 1 wherein the guide passages formed inside said guide passage members are shaped so as to gradually bend in a downstream direction of said main transport passage as the guide passages approach said main transport passage in order to smoothly guide paper slips from the respective paper slip discharger to said main transport passage, and wherein said feed rollers, said swing arms, said pressure rollers, and said urging members are located on an upstream side of a respective one of said guide passages.

* * * * *